US009698455B2

(12) United States Patent
Hendry et al.

(10) Patent No.: US 9,698,455 B2
(45) **Date of Patent: *Jul. 4, 2017**

(54) MULTI-MODE FILTER HAVING AT LEAST ONE FEED LINE AND A PHASE ARRAY OF COUPLING ELEMENTS

(75) Inventors: David Robert Hendry, Brisbane (AU); Steven John Cooper, Brisbane (AU); Peter Blakeborough Kenington, Chepstow (GB)

(73) Assignee: Mesaplex Pty Ltd., Queensland (AU)

( * ) Notice: Subject to any disclaimer, the term of this patent is extended or adjusted under 35 U.S.C. 154(b) by 394 days.

This patent is subject to a terminal disclaimer.

(21) Appl. No.: 13/531,003

(22) Filed: Jun. 22, 2012

(65) Prior Publication Data

US 2013/0049896 A1 Feb. 28, 2013

Related U.S. Application Data

(60) Provisional application No. 61/531,277, filed on Sep. 6, 2011.

(30) Foreign Application Priority Data

Aug. 23, 2011 (AU) ..... 2011903389

(51) Int. Cl.
*H01P 1/20* (2006.01)
*H01P 1/208* (2006.01)
*H01P 7/10* (2006.01)

(52) U.S. Cl.
CPC ..... *H01P 1/2086* (2013.01); *H01P 1/2088* (2013.01); *H01P 7/105* (2013.01); *H01P 1/2002* (2013.01); *Y10T 29/49016* (2015.01)

(58) Field of Classification Search
CPC ..... H01P 1/2082; H01P 1/2086; H01P 7/105; H01P 1/20; H01P 1/208
USPC ..... 333/202, 219.1
See application file for complete search history.

(56) References Cited

U.S. PATENT DOCUMENTS

| | | | |
|---|---|---|---|
| 2,890,421 A | 6/1959 | Currie | |
| 3,657,670 A | 4/1972 | Kitazume et al. | 333/73 W |
| 4,142,164 A | 2/1979 | Nishikawa et al. | |
| 4,614,920 A | 9/1986 | Tong | |

(Continued)

FOREIGN PATENT DOCUMENTS

| | | |
|---|---|---|
| CA | 1189154 A2 | 6/1985 |
| CA | 1194157 A1 | 9/1985 |

(Continued)

OTHER PUBLICATIONS

Awai, Ikuo, et al; Equivalent-Circuit Representation and Explanation of Attenuation Poles of a Dual-Mode Dielectric-Resonator Bandpass Filter; Transactions on Microwave Theory and Techniques; (Dec. 1998); pp. 2159-2163; vol. 46; No. 12; IEEE.

(Continued)

*Primary Examiner* — Benny Lee
(74) *Attorney, Agent, or Firm* — Harrington & Smith

(57) ABSTRACT

A multi-mode cavity filter includes a dielectric resonator body incorporating a piece of dielectric material, the piece of dielectric material having a shape such that it can support at least two substantially degenerate resonant modes; and a phased array of coupling elements for coupling signals to the piece of dielectric material.

16 Claims, 11 Drawing Sheets

(56) References Cited

U.S. PATENT DOCUMENTS

| | | | | |
|---|---|---|---|---|
| 4,622,523 | A | 11/1986 | Tang | |
| 4,623,857 | A | 11/1986 | Nishikawa et al. | |
| 4,630,009 | A | 12/1986 | Tang | |
| 4,644,305 | A | 2/1987 | Tang et al. | |
| 4,675,630 | A | 6/1987 | Tang et al. | |
| 4,792,771 | A | 12/1988 | Siu | |
| 4,879,533 | A | 11/1989 | de Muro et al. | 333/206 |
| 4,963,844 | A | 10/1990 | Konishi | |
| 5,023,866 | A | 6/1991 | De Muro | 370/24 |
| 5,307,036 | A | 4/1994 | Turunen et al. | 333/202 |
| 5,325,077 | A | 6/1994 | Ishikawa et al. | 333/219.1 |
| 5,585,331 | A | 12/1996 | Mansour et al. | |
| 5,589,807 | A | 12/1996 | Tang | |
| 5,710,530 | A | 1/1998 | Wada et al. | |
| 5,731,751 | A | 3/1998 | Vangala | |
| 5,805,035 | A | 9/1998 | Accatino et al. | |
| 5,821,837 | A | 10/1998 | Accatino et al. | |
| 6,005,457 | A | 12/1999 | Wu | |
| 6,016,091 | A | 1/2000 | Hidaka et al. | 333/202 |
| 6,025,291 | A | 2/2000 | Murakawa | 501/136 |
| 6,066,996 | A | 5/2000 | Goertz et al. | |
| 6,072,378 | A | 6/2000 | Kurisu et al. | |
| 6,133,808 | A | 10/2000 | Arakawa | 333/134 |
| 6,160,463 | A | 12/2000 | Arakawa et al. | 333/202 |
| 6,278,344 | B1 | 8/2001 | Kurisu et al. | |
| 6,346,867 | B2 | 2/2002 | Arakawa et al. | 333/208 |
| 6,462,629 | B1 | 10/2002 | Blair et al. | |
| 6,549,094 | B2 | 4/2003 | Takagi et al. | 333/134 |
| 6,677,837 | B2 * | 1/2004 | Kojima et al. | 333/208 |
| 6,762,658 | B1 | 7/2004 | Isomura et al. | 333/202 |
| 6,825,740 | B2 | 11/2004 | Kundu | 333/202 |
| 6,834,429 | B2 | 12/2004 | Blair et al. | |
| 6,853,271 | B2 | 2/2005 | Wilber et al. | |
| 6,897,741 | B2 | 5/2005 | Ando et al. | |
| 6,954,122 | B2 | 10/2005 | Wilber et al. | |
| 7,042,314 | B2 | 5/2006 | Wang et al. | 333/202 |
| 7,068,127 | B2 | 6/2006 | Wilber et al. | |
| 7,138,891 | B2 | 11/2006 | Andoh et al. | |
| 7,605,678 | B2 | 10/2009 | Ando et al. | |
| 7,755,456 | B2 | 7/2010 | Salehi | |
| 8,022,792 | B2 | 9/2011 | Howard | |
| 8,325,077 | B2 | 12/2012 | Gentric | 341/173 |
| 2001/0000429 | A1 * | 4/2001 | Arakawa et al. | 333/208 |
| 2001/0024147 | A1 | 9/2001 | Arakawa et al. | 333/135 |
| 2002/0024410 | A1 | 2/2002 | Guglielmi et al. | 333/202 |
| 2002/0039058 | A1 | 4/2002 | Sano et al. | 333/202 |
| 2003/0006864 | A1 | 1/2003 | Hattori et al. | 333/202 |
| 2003/0090344 | A1 | 5/2003 | Wang et al. | 333/202 |
| 2003/0141948 | A1 | 7/2003 | Maekawa et al. | |
| 2003/0227360 | A1 | 12/2003 | Kirihara et al. | 333/239 |
| 2004/0041660 | A1 | 3/2004 | Kawahara et al. | |
| 2004/0056736 | A1 | 3/2004 | Enokihara et al. | 333/202 |
| 2005/0128031 | A1 | 6/2005 | Wilber et al. | 333/202 |
| 2005/0140474 | A1 | 6/2005 | Kim et al. | 333/219.1 |
| 2005/0253672 | A1 | 11/2005 | Enokihara et al. | 333/219.1 |
| 2006/0139127 | A1 | 6/2006 | Wada et al. | 333/202 |
| 2008/0018391 | A1 | 1/2008 | Bates | 327/557 |
| 2008/0061905 | A1 | 3/2008 | Ishikawa | |
| 2008/0211601 | A1 | 9/2008 | Bates | 333/186 |
| 2010/0231323 | A1 | 9/2010 | Vangala et al. | |
| 2011/0006856 | A1 | 1/2011 | Kim et al. | |
| 2011/0128097 | A1 | 6/2011 | Park et al. | |
| 2014/0077900 | A1 | 3/2014 | Rogozine et al. | 333/212 |

FOREIGN PATENT DOCUMENTS

| | | | |
|---|---|---|---|
| EP | 0883203 | A3 | 10/1999 |
| JP | H0216801 | | 1/1990 |
| JP | H-10284988 | | 1/1998 |
| JP | H-1079636 | | 3/1998 |
| JP | H-10209808 | | 8/1998 |
| JP | H-10224113 | | 8/1998 |
| JP | H-10294644 | | 11/1998 |
| JP | H-10322161 | | 12/1998 |
| JP | 2000295072 | A | 10/2000 |
| JP | 2001060604 | A | 3/2001 |
| JP | 2001060805 | A | 3/2001 |
| JP | 2001160702 | A | 6/2001 |
| JP | 2002135003 | A | 5/2002 |
| JP | 2002151906 | A | 5/2002 |
| JP | 2002217663 | A | 8/2002 |
| JP | 2003037476 | A | 2/2003 |
| JP | 2003188617 | A | 7/2003 |
| JP | 2003234635 | A | 8/2003 |
| JP | 2004312287 | A | 11/2004 |
| JP | 2004312288 | A | 11/2004 |
| JP | 2005065040 | A | 3/2005 |
| JP | 2005167577 | A | 6/2005 |
| JP | 2005223721 | A | 8/2005 |
| WO | WO-9301626 | A1 | 1/1993 |
| WO | WO-0077883 | A1 | 12/2000 |
| WO | WO-02078119 | A1 | 10/2002 |

OTHER PUBLICATIONS

Awai, Ikuo, et al; Coupling of Dual Modes in a Dielectric Waveguide Resonator and its Application to Bandpass Filters; Proceedings of the 25th European Microwave Conference; (1995); pp. 533-537; Conf. 25; Yamaguchi University, Japan.

Weily, Andrew R, et al; Rotationally Symmetric FDTD for Fast Design and Wideband Spurious Performance Prediction of Dielectric Resonator Filters; Telecom Group, Faculty of Engineering, University of Technology; (1999); pp. 844-847.

Chaudhary, Raghvendra Kumar, et al.; Multi-Layer Multi-Permittivity Dielectric Resonator: A New Approach for Improved Spurious Free Window; Proceedings of the 40th European Microwave Conference; (Sep. 28-30, 2010); pp. 1194-1197; Paris, France.

Sano, Kazuhisa, et al.; Application of the Planar I/O Terminal to Dual Mode Dielectric Waveguide Filters; International Microwave Symposium Digest; (Jun. 11-16, 2000); pp. 1173-1176; Boston, MA.

Wang, Chi, et al; A Practical Triple-Mode Monoblock Bandpass Filter for Base Station Applications; MTT-S Digest; (2001); pp. 1783-1786.

Awai, Ikuo, et al; A Dual Mode Dielectric Waveguide Resonator and its Application to Bandpass Filters; IEICE Transactions on Electronics; (Aug. 1995); pp. 1018-1025; vol. E78-C; No. 8.

Bekheit, Maged, et al.; Modeling and Optimization of Compact Microwave Bandpass Filters; IEEE Transactions of Microwave Theory and Techniques; (Feb. 2008); pp. 420 430; vol. 56; No. 2.

Dupont, "Properties Handbook", Dupont, p. 4 (30 pgs.), Nov. 2003.

Trak Ceramics, "Dielectric Materials", Trak Ceramics, Inc., p. 1 (8 pgs.), Jun. 1, 2000.

* cited by examiner

MULTI-MODE FILTER HAVING AT LEAST ONE FEED LINE AND A PHASE ARRAY OF COUPLING ELEMENTS

CROSS REFERENCE TO RELATED APPLICATIONS

The present application is related to and claims the benefit of Australian Provisional Patent Application No. 2011903389, filed Aug. 23, 2011 and U.S. Provisional Patent Application No. 61/531,277, filed Sep. 6, 2011, both of whose disclosures are hereby incorporated by reference in their entirety into the present disclosure.

TECHNICAL FIELD

The present invention relates to filters, and in particular to a multi-mode filter including a resonator body for use, for example, in frequency division duplexers for telecommunication applications.

BACKGROUND

The reference in this specification to any prior publication (or information derived therefrom), or to any matter which is known, is not, and should not be taken as an acknowledgment or admission or any form of suggestion that the prior publication (or information derived therefrom) or known matter forms part of the common general knowledge in the field of endeavour to which this specification relates.

All physical filters essentially consist of a number of energy storing resonant structures, with paths for energy to flow between the various resonators and between the resonators and the input/output ports. The physical implementation of the resonators and the manner of their interconnections will vary from type to type, but the same basic concept applies to all. Such a filter can be described mathematically in terms of a network of resonators coupled together, although the mathematical topology does not have to match the topology of the real filter.

Conventional single-mode filters formed from dielectric resonators are known. Dielectric resonators have high-Q (low loss) characteristics which enable highly selective filters having a reduced size compared to cavity filters. These single-mode filters tend to be built as a cascade of separated physical dielectric resonators, with various couplings therebetween and to the ports. These resonators are easily identified as distinct physical objects, and the couplings tend also to be easily identified.

Single-mode filters of this type may include a network of discrete resonators formed from ceramic materials in a "puck" shape, where each resonator has a single dominant resonance frequency, or mode. These resonators are often coupled together by providing openings between cavities in which the resonators are located. Typically, the resonators provide transmission poles or "zeros", which can be tuned at particular frequencies to provide a desired filter response. A number of resonators will usually be required to achieve suitable filtering characteristics for commercial applications, resulting in filtering equipment of a relatively large size.

One example application of filters formed from dielectric resonators is in frequency division duplexers for microwave telecommunication applications. Duplexers have traditionally been provided at base stations at the bottom of antenna supporting towers, although a current trend for microwave telecommunication system design is to locate filtering and signal processing equipment at the top of the tower to thereby minimise cabling lengths and thus reduce signal losses. However, the size of single mode filters as described above can make these filters undesirable for implementation at the top of antenna towers.

Multi-mode filters implement several resonators in a single physical body, such that reductions in filter size can be obtained. As an example, a silvered dielectric body can resonate in many different modes. Each of these modes can act as one of the resonators in a filter. In order to provide a practical multi-mode filter it is necessary to couple the energy between the modes within the body, in contrast with the coupling between discrete objects in single mode filters, which coupling is easier to control in practice.

The usual manner in which these multi-mode filters are implemented is to selectively couple the energy from an input port to a first one of the modes. The energy stored in the first mode is then coupled to different modes within the resonator by introducing specific defects into the shape of the body. In this manner, a multi-mode filter can be implemented as an effective cascade of resonators, in a similar way to conventional single mode filter implementations. Again, this technique results in transmission poles which can be tuned to provide a desired filter response.

An example of such an approach is described in U.S. Pat. No. 6,853,271, which is directed towards a triple-mode mono-body filter. Energy is coupled into a first mode of a dielectric-filled mono-body resonator, using a suitably configured input probe provided in a hole formed on a face of the resonator. The coupling between this first mode and two other modes of the resonator is accomplished by selectively providing corner cuts or slots on the resonator body.

This technique allows for substantial reductions in filter size because a triple-mode filter of this type represents the equivalent of a single-mode filter composed of three discrete single mode resonators. However, the approach used to couple energy into and out of the resonator, and between the modes within the resonator to provide the effective resonator cascade, requires the body to be of complicated shape, increasing manufacturing costs.

Two or more triple-mode filters may still need to be cascaded together to provide a filter assembly with suitable filtering characteristics. As described in U.S. Pat. Nos. 6,853,271 and 7,042,314, this cascade of filters may be achieved using a waveguide or aperture for providing coupling between two resonator mono-bodies. Another approach includes using a single-mode combine resonator coupled between two dielectric mono-bodies to form a hybrid filter assembly as described in U.S. Pat. No. 6,954,122. In any case the physical complexity and hence manufacturing costs are even further increased.

SUMMARY OF THE INVENTION

According to a first aspect, a multi-mode cavity filter comprises a dielectric resonator body incorporating a piece of dielectric material, the piece of dielectric material having a shape such that the dielectric resonator body can support at least two substantially degenerate resonant modes; and a phased array of coupling elements for coupling signals to the piece of dielectric material.

The multi-mode cavity filter may further comprise a signal transmission line for transmitting a signal to at least one of the plurality of the coupling elements. The phase of the signal at a particular coupling element along the transmission line may be determined by the position of that coupling element along the transmission line.

The transmission line may include at least one meander to increase the length of the transmission line.

The or each coupling element may be positioned at a predetermined distance along the transmission line such that the signal reaching the or each coupling element has a predetermined phase.

At least some of the plurality of coupling elements may be connected to each other in series.

The phased array of coupling elements may comprise a primary transmission line configured to feed signals to plurality of secondary transmission lines branching off the primary transmission line, wherein each of the plurality of secondary transmission lines is configured to transmit a signal to at least one coupling element.

The coupling elements may be electrically independent or isolated from one another.

The multi-mode cavity filter may further comprise an amplitude determination mechanism for determining the amplitude of a signal transmitted along the transmission line. The relative amplitudes of signals transmitted to each of the coupling elements may be predetermined.

The plurality of coupling elements may be arranged in a substantially symmetrical array.

Some of the plurality of coupling elements may be input elements arranged to deliver signals to the piece of dielectric material, and others of the plurality of coupling elements may be output elements arranged to recover signals from the piece of dielectric material. At least one input element may be coupled to at least one output element.

The piece of dielectric material may comprise at least two faces, the input elements may be arranged on a first of the at least two faces, and the output elements may be arranged on a second of the at least two faces. Alternatively, the input and output elements may be arranged on a single face.

At least some of the plurality of coupling elements may be patches formed on a surface of the piece of dielectric material. At least some of the patches may be of a regular geometric shape. Additionally or alternatively, at least some of the patches may be of an irregular geometric shape.

At least some of the plurality of coupling elements may be probes arranged to abut a surface of, or at least partially penetrate a surface of, the piece of dielectric material. The probes may have a substantially circular cross section.

A shielding element may be associated with each probe.

At least some of the plurality of coupling elements may be magnetic field generating elements. The magnetic field generating elements may be loop elements.

The plurality of coupling elements may comprise at least a first set of coupling elements configured to couple a first signal to the piece of dielectric material for exciting a first resonant mode of the dielectric resonator, and a second set of coupling elements configured to couple a second signal to the piece of dielectric material for exciting a second resonant mode of the dielectric resonator.

According to a second aspect, a method of manufacturing a multi-mode cavity filter comprises: providing a resonator body of dielectric material capable of supporting at least two substantially degenerate resonant modes; and providing a phased array of coupling elements for coupling signals to the piece of dielectric material.

According to another embodiment, a multi-mode cavity filter may comprise a dielectric resonator body incorporating a piece of dielectric material, the piece of dielectric material having a shape such that the dielectric resonator body can support at least two substantially degenerate resonant modes; and a coupling structure comprising a plurality of independent coupling elements for coupling signals to the piece of dielectric material.

At least some of the plurality of coupling elements may be connected to each other in series.

The multi-mode cavity filter may further comprise a primary transmission line configured to transmit signals to a plurality of secondary transmission lines branching off the primary transmission line, wherein each of the plurality of secondary transmission lines is configured to feed a signal to a single coupling element.

According to another embodiment, a method of manufacturing a multi-mode cavity filter may comprise: providing a resonator body of dielectric material capable of supporting at least two substantially degenerate resonant modes, and providing a coupling structure comprising a plurality of coupling elements for coupling signals to the piece of dielectric material.

BRIEF DESCRIPTION OF THE DRAWINGS

For a better understanding of the present invention, and to show more clearly how the invention may be carried into effect, reference will now be made, by way of example, to the following drawings, in which.

DETAILED DESCRIPTION OF THE INVENTION

An example of a multi-mode filter will now be described with reference to the drawings, where like features in different drawings are denoted by the same reference numbers.

Figure 1:
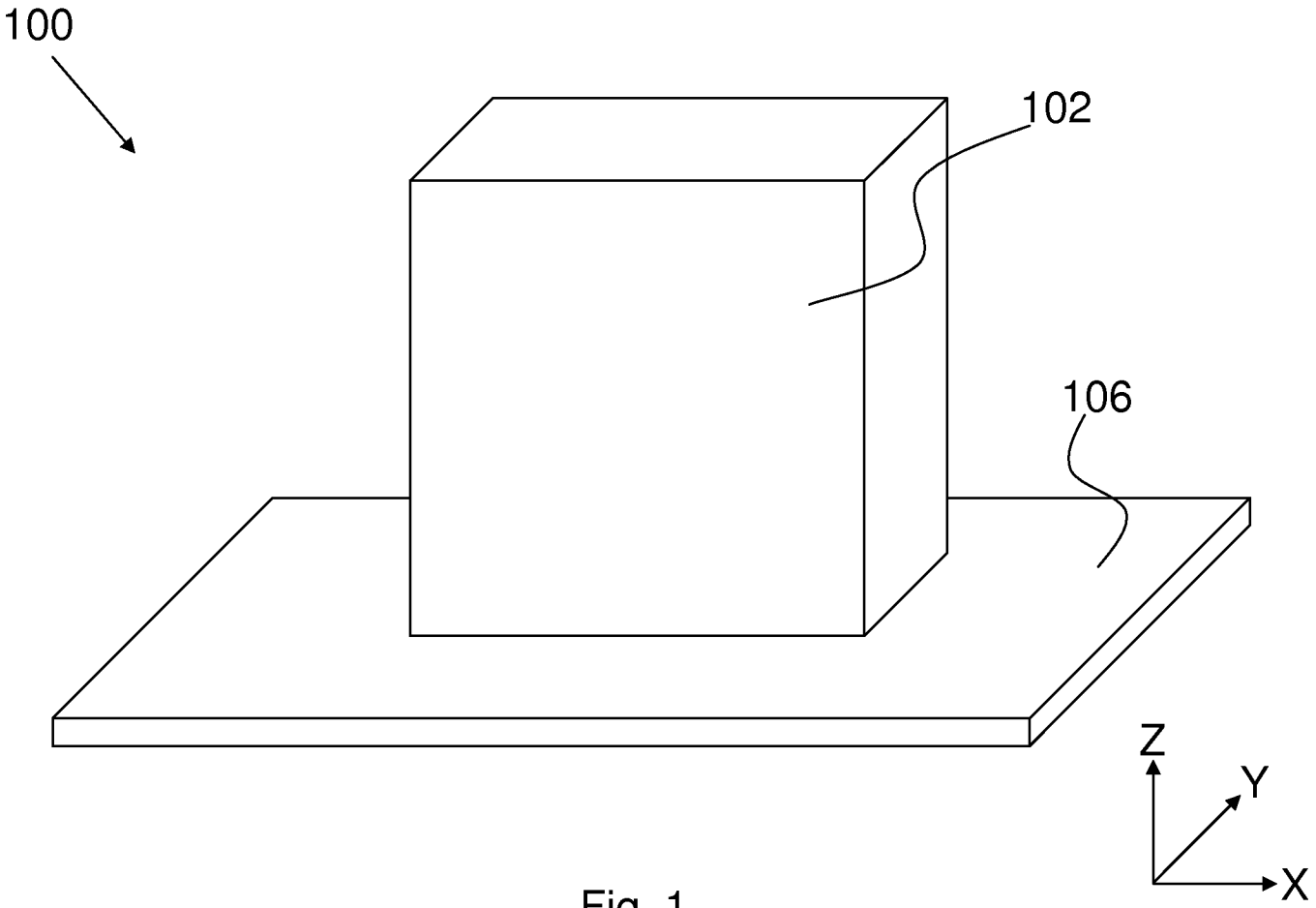
FIG. 1 is a schematic perspective view of an example of a multi-mode filter.

FIG. 1 shows a filter 100 having a resonator body 102 which is coupled by a coupling structure 104 (not shown in FIG. 1, but shown in FIGS. 2 to 4, and 7 to 11) to a substrate 106. The coupling structure 104 is located on a surface of the resonator body 102 that is adjacent to the substrate 106. The substrate 106 and the coupling structure 104 will be discussed in further detail below. The resonator body 102 is formed from a piece of dielectric material having suitable dielectric properties. In one example, the resonator body 102 is a ceramic material, although this is not essential and alternative materials can be used. Additionally, the body 102 can be a multilayered body including, for example, layers of materials having different dielectric properties. In one example, the body 102 can include a core of a dielectric material, and one or more outer layers of different dielectric materials.

The coupling structure 104 provides coupling to a plurality of the resonance modes of the resonator body. In use, a radio frequency signal, containing, say, frequencies from within the 1 MHz to 100 GHz range, can be supplied to or received from the coupling structure 104. In a suitable configuration, this allows a signal to be filtered to be supplied to the resonator body 102 for filtering, or can allow a filtered signal to be obtained from the resonator body, as will be described in more detail below.

The use of an electrically conductive coupling structure formed from an array of individual elements electrically independent from one another allows the signal to be coupled to a plurality of resonance modes of the resonator body 102. This allows a more simplified configuration of resonator body 102 and coupling structure 104 to be used as compared to traditional arrangements. For example, this avoids the need to have a resonator body including cut-outs or other complicated shapes, as well as avoiding the need for coupling structures that extend into the resonator body. This, in turn, makes the filter less expensive and simpler to manufacture, and can provide enhanced filtering characteristics. In addition, the filter is small in size, typically of the order of 6000 $mm^3$ per resonator body, making the filter apparatus suitable for use at the top of antenna towers. It will be appreciated by those skilled in the art that, while the individual coupling elements are electrically independent from one another, there will inevitably be some degree of mutual coupling between some couplings which will need to be taken into account in the design of the filter. This mutual coupling is, however, incidental, and not an intended part of the operation of the invention.

A number of further features will now be described.

The resonator body 102 usually includes an external coating (FIG. 2; 110) of conductive material, such as silver, although other materials could be used such as gold, copper, or the like. The conductive material may be applied to one or more surfaces of the body. A region of the surface adjacent the coupling structure 104, that is the surface at which the resonator body 102 is coupled to the substrate 106, may be uncoated to allow coupling of signals to the resonator body.

The resonator body 102 can be any shape, but generally defines at least two orthogonal axes. In the current example, the resonator body 102 is a cuboid body, and therefore defines three orthogonal axes substantially aligned with surfaces of the resonator body, as shown by the axes X, Y, Z. As a result, the resonator body 102 has three dominant resonance modes that are substantially orthogonal and substantially aligned with the three orthogonal axes.

Cuboid structures are particularly advantageous as they can be easily and inexpensively manufactured, and can also be easily fitted together, for example by arranging multiple resonator bodies in contact. Cuboid structures typically have clearly defined resonance modes, making configuration of the coupling structure more straightforward. Additionally, the use of a cuboid structure provides a planar surface so that the coupling structure can be arranged in a single plane parallel to the planar surface. This can help maximise coupling between the couplings and resonator body 102, as well as allowing the coupling structure 104 to be more easily manufactured.

For example, the couplings may be provided on the substrate 106. In this instance, the provision of a planar surface 108 (FIG. 2) allows the substrate 106 to be a planar substrate, such as a printed circuit board (PCB) or the like. However, alternative arrangements can be used, such as coating the coupling structure 104 onto the resonator body directly.

In use, resonance modes of the resonator body provide respective energy paths between the input and output. Furthermore, the input coupling and the output coupling can be configured to allow coupling therebetween to provide an energy path separate to energy paths provided by the resonance modes of the resonator body. This can provide four parallel energy paths between the input and the output. These energy paths can be arranged to introduce at least one transmission zero to the frequency response of the filter, as will be described in more detail below. In this regard, the term "zero" refers to a transmission minimum in the frequency response of the filter, meaning transmission of signals at that frequency will be minimal, as will be understood by persons skilled in the art.

Figure 2:
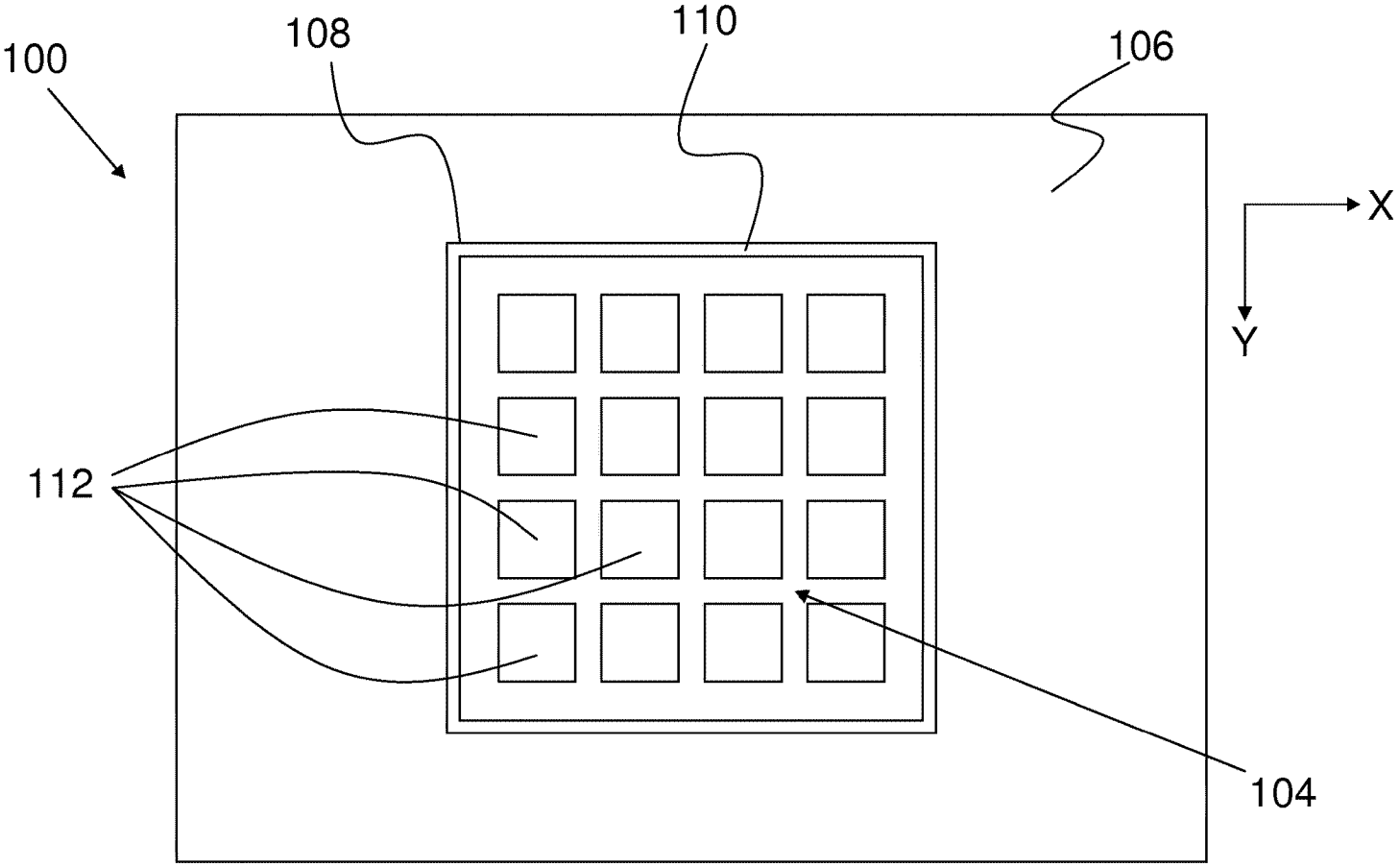
FIG. 2 is a schematic underside view of the multi-mode filter of FIG. 1.

A specific example filter is shown in FIG. 2. In this example, the filter 100 includes a resonator body 102 (FIG. 1) having a surface 108 (FIG. 2) at which the body is coupled to the substrate 106. A coating 110 of conductive material (such as metal) is formed around the periphery of the surface 108. The coating 110 may be formed on at least one of the other faces of the resonator body 102. In some embodiments, all of the other faces of the resonator body 102 are at least partially coated by the coating 110. However, as noted above, the surface 108 of the body adjacent the substrate 106 is left substantially uncoated to allow signals to be coupled to the resonator body 102, with the remainder of the surface, which is coated, being electrically connected to the groundplane located on, or within the substrate.

The coupling structure 104 of this embodiment is formed from an array of pads or patches 112 insulated from each other and through which signals are transmitted to and/or recovered from the resonator body 102. The mutual insulation of each patch keeps the interference of signals between the patches to a minimum. In the embodiment shown in FIG. 2, the coupling structure 104 includes an array of sixteen substantially square patches 112 arranged in a 4 by 4 configuration. The patches 112 are configured to couple to a track or to connectors on the substrate 106. As an alternative to being connected directly to the substrate 106, in other embodiments, the patches 112 may be connected to a printed circuit board (not shown) via which signals are fed to the resonator body 102.

Each of the patches 112 includes at least one connection, or feed point (not shown), to which a feed line (not shown) can be connected for provision of a signal to the patch. In some embodiments, each patch 112 includes two or more feed points. Similarly, in some embodiments, the or each feed point is located centrally within the patch 112 whereas, in other embodiments, the or each feed point is located offset from the centre of the patch.

Although, in this embodiment, each of the patches 112 has a square shape, the patches can be any shape. In some embodiments, the patches 112 are compact shapes such as circles, triangles, squares, pentagons and the like. In other embodiments, the patches 112 are elongated shapes such as rectangles, ellipses and the like. Similarly, while, in this embodiment, all of the patches 112 are the same shape, in other embodiments, a combination of patches of different compact geometric shapes, or a combination of patches of compact and elongated geometric shapes may be used. Patches 112 of compact geometric shapes have greater rotational symmetry than patches of elongated geometric shapes and, consequently, compact geometric shaped patches couple predominantly to the electric field (E-field), with relatively little coupling to the magnetic field (H-field).

In contrast, patches having elongated geometric shapes couple to a greater degree to the H-field in addition to the E-field coupling.

In addition to the shape of the patches 112, the size of the patches is also determinative with regard to the strength with which the patches couple to the E-field and to the H-field. Relatively small patches couple primarily to the E-field. Relatively large patches contribute an amount of H-field coupling in addition to the E-field coupling. It will be appreciated that a combination of patches of different sizes may be used to achieve a desired coupling to the E-field and the H-field.

Another factor that determines the amount by which the patches 112 contribute to the E-field and the H-field is the position of the feed point (that is, the signal input point) into each patch. If the point at which a signal is fed into a patch 112 is substantially central in the patch, then the predominant excitation provided by the patch is an E-field excitation. However, if the signal is fed into the patch at a point offset from the centre, then H-field excitation is generated in addition to an E-field excitation.

Figure 3:
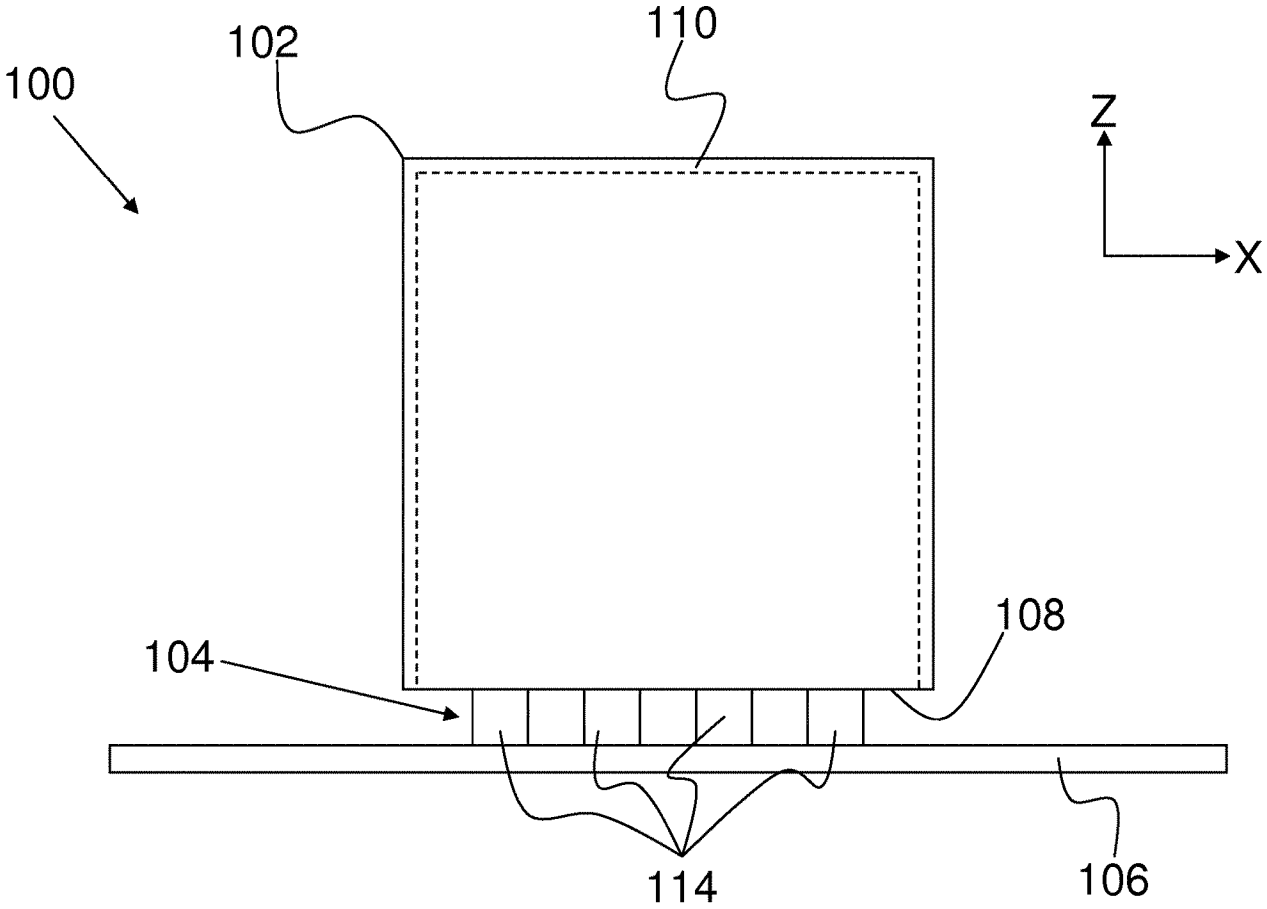
FIG. 3 is a schematic side view of a further example of a multi-mode filter.
Figure 4:
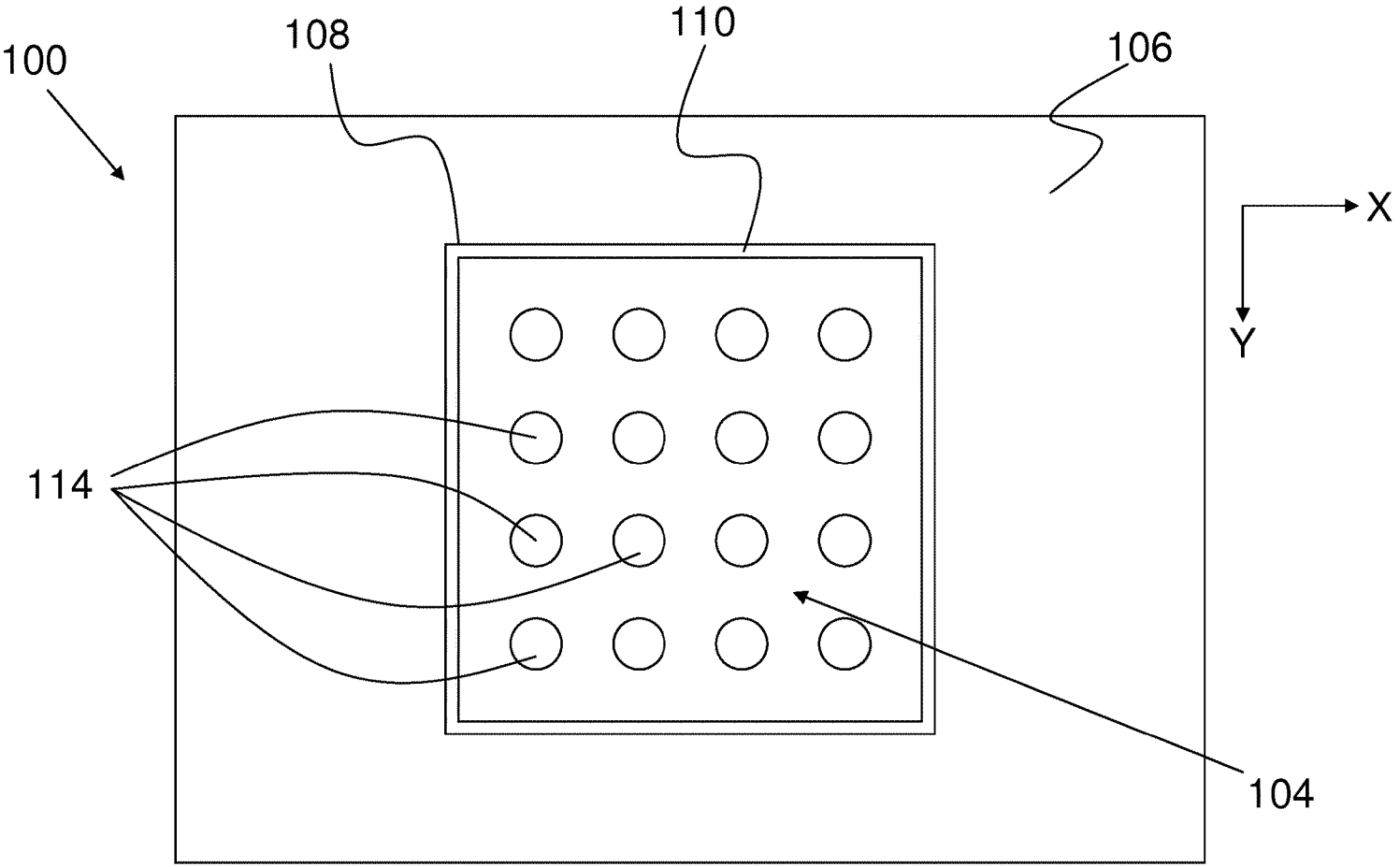
FIG. 4 is a schematic underside view of the multi-mode filter of FIG. 3.

FIGS. 3 and 4 show a side view and an underside view respectively of an alternative embodiment of the invention in which the coupling structure 104 is formed from an array of probes 114. Each of the probes 114 is an elongate conductor which is configured to couple, at one end, to a track or to connectors on the substrate 106, and at the other end, to the surface 108 of the resonator body 102 (FIG. 3). In this embodiment, the probes 114 are substantially circular in cross section (see FIG. 4). However, probes having other cross sections, such as square or elliptical, may be used in alternative embodiments. A number of connections, such as a connection between the metallic coating 110 and a track or groundplane layer on the substrate 106, have been omitted from FIG. 3 (and FIGS. 5 and 6) for clarity. Those skilled in the art will appreciate, however, that the filter 100 may include further connections and components not essential to the understanding of this invention and which have been omitted from the drawings.

As with the embodiments described above in which the coupling structure 104 includes patches 112, the probes 114 may be arranged in a regular array, for example in a 4 by 4 configuration. Alternatively, a smaller or larger array may be used, and/or the probes may be arranged in an irregular configuration.

Figure 5:
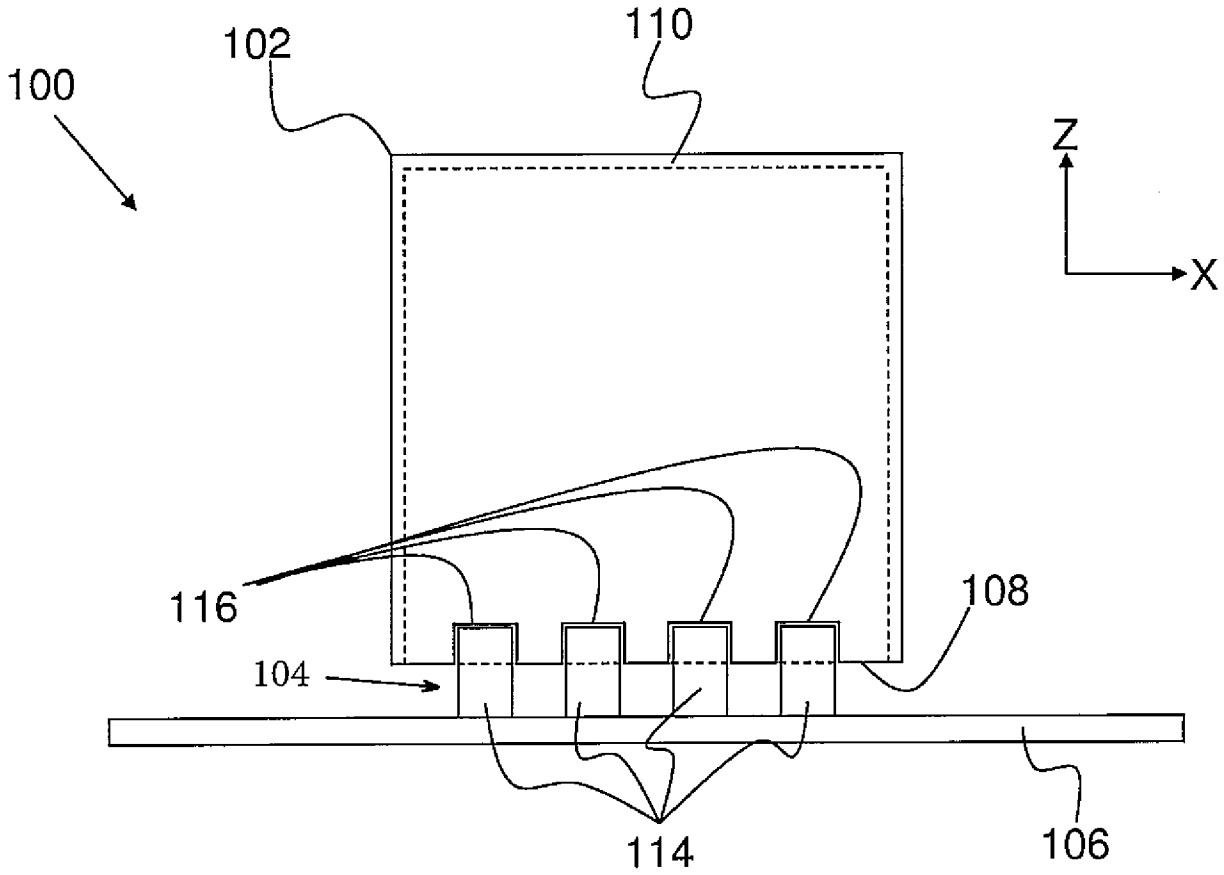
FIG. 5 is a schematic side view of a further example of the multi-mode filter of FIG. 3.

In FIG. 5, the resonator body 102 is shown having a coupling structure 104 which includes an array of probes 114 which penetrate the surface 108 of the resonator body 102. Each probe 114 is configured to fit into one of an array of complementary-shaped recesses 116 formed in the resonator body 102. In some embodiments, the probes 114 penetrate a short depth into the resonator body 102. In other embodiments, the probes 114 penetrate a substantial proportion of their length into the resonator body 102. The lengths of the probes 114 has an effect on the degree of coupling afforded from the probe to the resonator body 102. Thus, the lengths of the probes can be chosen according to the coupling required at each probe 114. In some embodiments, some probes 114 in an array can have lengths that differ from other probes in the array, thereby creating a desired field pattern to excite particular modes within the resonator body 102.

Figure 6:
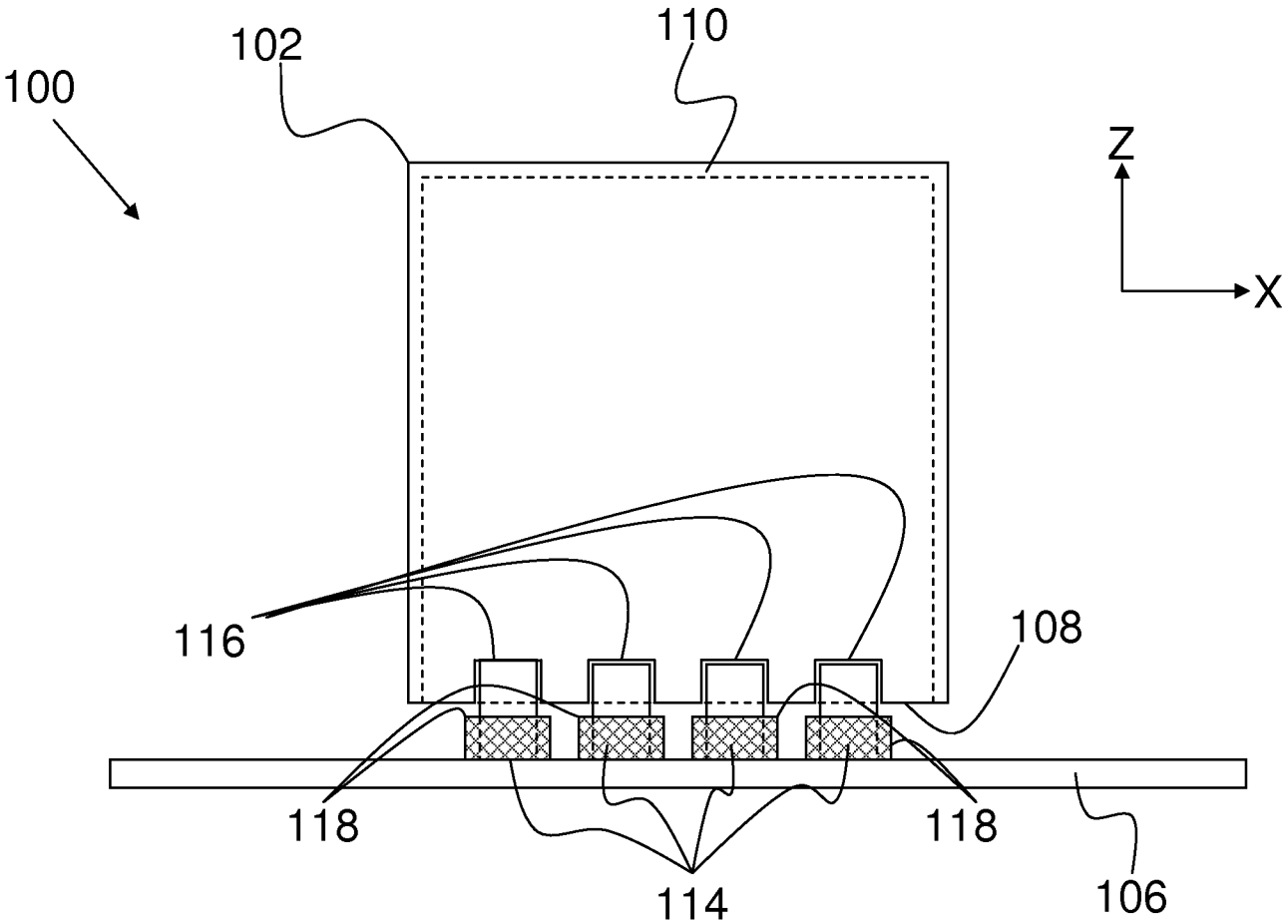
FIG. 6 is a schematic side view of a further example of the multi-mode filter of FIG. 5.

FIG. 6 shows an alternative embodiment of the invention in which each of the probes 114 includes a shielding element 118. Each shielding element 118 is a grounded conductor which at least partially surrounds a corresponding probe 114. The shielding elements 118 are configured and positioned such that they are in contact with the metallic coating 110 surrounding the resonator body 102, and may take any known form, such as a wire mesh ring or a solid shield. In some embodiments, where the probes 114 are shorter than a particular length, shielding elements 118 are not required and may, therefore, be omitted.

The degree of coupling of the signal from each probe 114 to a resonance mode of the resonator body 102 is, in part, determined by the length of the probe. The length of each probe 114 also has an effect on the degree of H-field coupling relative to the E-field coupling from the probe. Additionally, the amount by which a probe 114 penetrates into the resonator body 102 affects the degree of coupling from the probe. A relatively long probe which penetrates relatively deeply into the resonator body 102 generates a greater H-field coupling than a relatively shorter probe, or a probe that penetrates a shorter depth into the resonator body 102. A relatively very short probe 114 contributes little or no H-field coupling. What constitutes 'long' and 'short' in terms of probe length depends on the degree of penetration of the probe into the resonator body 102: a short probe is one which has minimal penetration into the body, and a long probe is one which penetrates the body to a significant degree.

So far, two alternatives for the elements of the coupling structure have been described—patches 112 and probes 114. In an alternative embodiment, the coupling structure 104 includes an array of loop elements (not shown), which may be arranged in a configuration similar to those described above. The loop elements serve to couple substantially to the H-field, with relatively little E-field coupling occurring.

It will be apparent to those skilled in the art that, in alternative embodiments, a combination of patches 112, probes 114 and loop elements might be implemented in order to achieve a desired field pattern and to achieve a desired level of excitation of particular modes within the resonator body 102.

Figure 7:
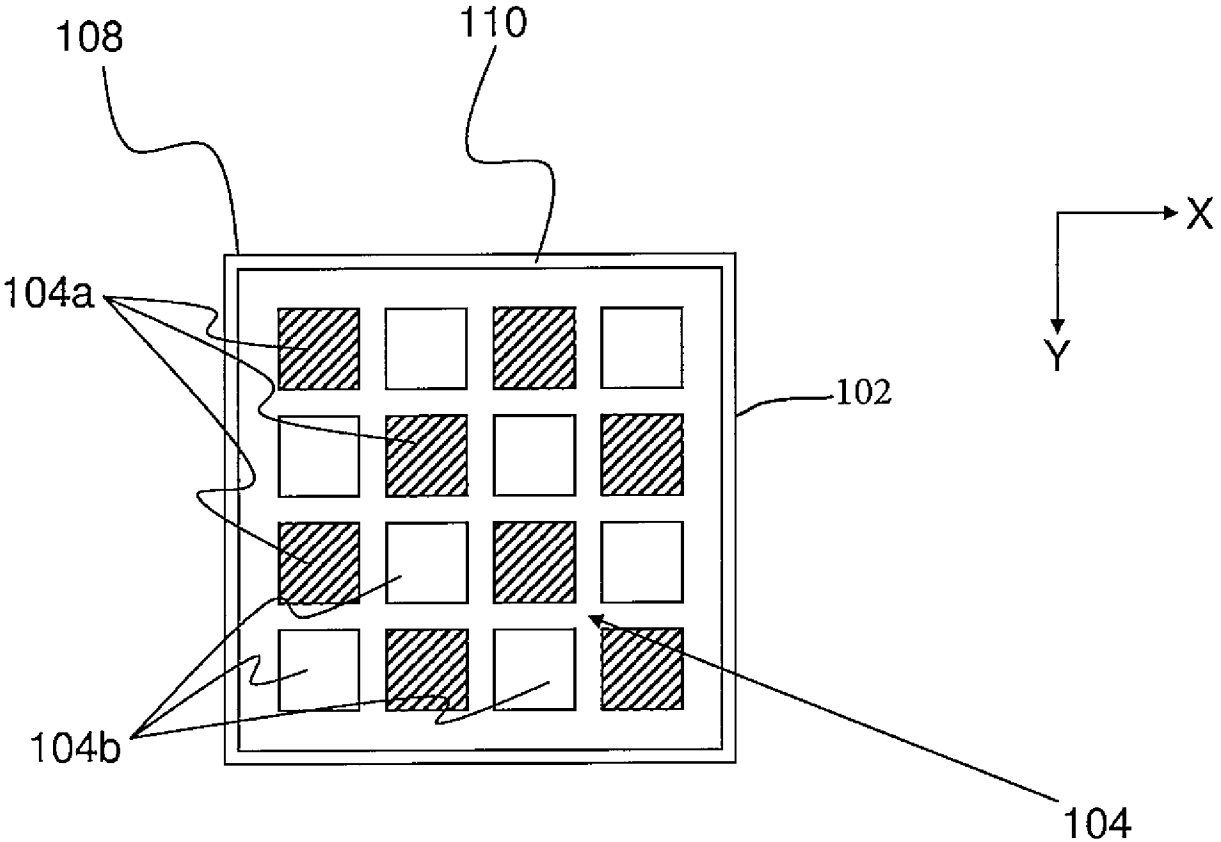
FIG. 7 is a schematic underside view of a further example of a multi-mode filter.

So far, in the above examples, nothing has been said regarding the functions of the individual elements of the coupling structure 104. FIG. 7 shows an embodiment in which the coupling structure 104 includes two types of couplings: input couplings 104*a* (shown with hatching), and output couplings 104*b* (shown without hatching). In this instance, a signal supplied via one of the inputs 104*a* couples to the resonance modes of the resonator body 102, so that a filtered signal is obtained via the outputs 104*b*. While, in this example, half of the coupling elements are inputs 104*a* and half of the coupling elements are outputs 104*b*, it will be appreciated that this arrangement is for the purpose of example only, and fewer or more input and/or output couplings may be used depending on the preferred implementation. Moreover, the arrangement of inputs and outputs on the resonator body 102 may be varied as described below.

In one example, different coupling structures can be provided on different surfaces of the resonator body. A further alternative is for a coupling structure to extend over multiple surfaces of the resonator body, with different coupling elements being provided on different surfaces (for example, an array of input couplings on one surface of the resonator body 102 and an array of output couplings on a different surface of the resonator body), or with coupling elements extending over multiple surfaces. Such arrangements can be used to allow a particular configuration of input and output to be accommodated, for example to meet physical constraints associated with other equipment, or to allow alternative coupling arrangements to be provided. In use, a configuration of the input and output coupling elements, along with the configuration of the resonator body 102 controls a degree of coupling with each of the plurality of resonance modes and hence the properties of the filter, such as the frequency response.

In addition to couplings for feeding signals to and from the resonator body 102, in some examples of the invention, one or more of the inputs are coupled to one or more of the outputs and vice versa.

Signals are fed to each of the patches 112 and probes 114 via one or more transmission or feed lines. The feed lines may take the form, for example, of a track on a PCB. In some examples of the invention, such as in the example shown in FIG. 8, a feed line 120 is connected to a plurality of input couplings 104*a* in series. In this example, the feed line 120 is coupled only to the input couplings 104*a*. However, in other embodiments, the feed line may be coupled to more or fewer patches 112 or probes 114. The meandering nature of the feed line 120 allows a designer of the filter 100 to select which coupling elements the feed line is connected to, and the order in which they are connected. Furthermore, as will be discussed further below, the length of the feed line can be selected such that the signal arriving at any particular coupling element has a desired phase.

Figure 8:
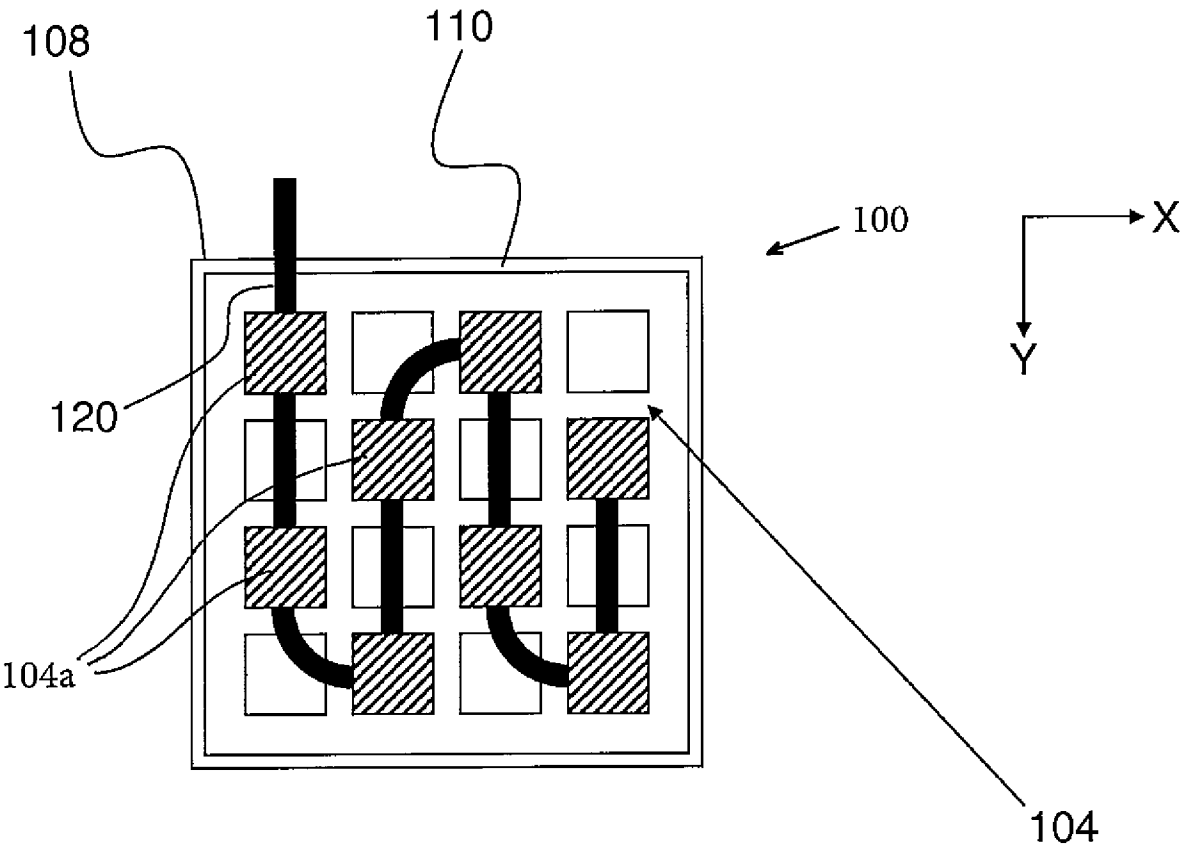
FIGS. 8 to 11 are schematic underside views of further examples of the multi-mode filter of FIG. 7.
Figure 9:
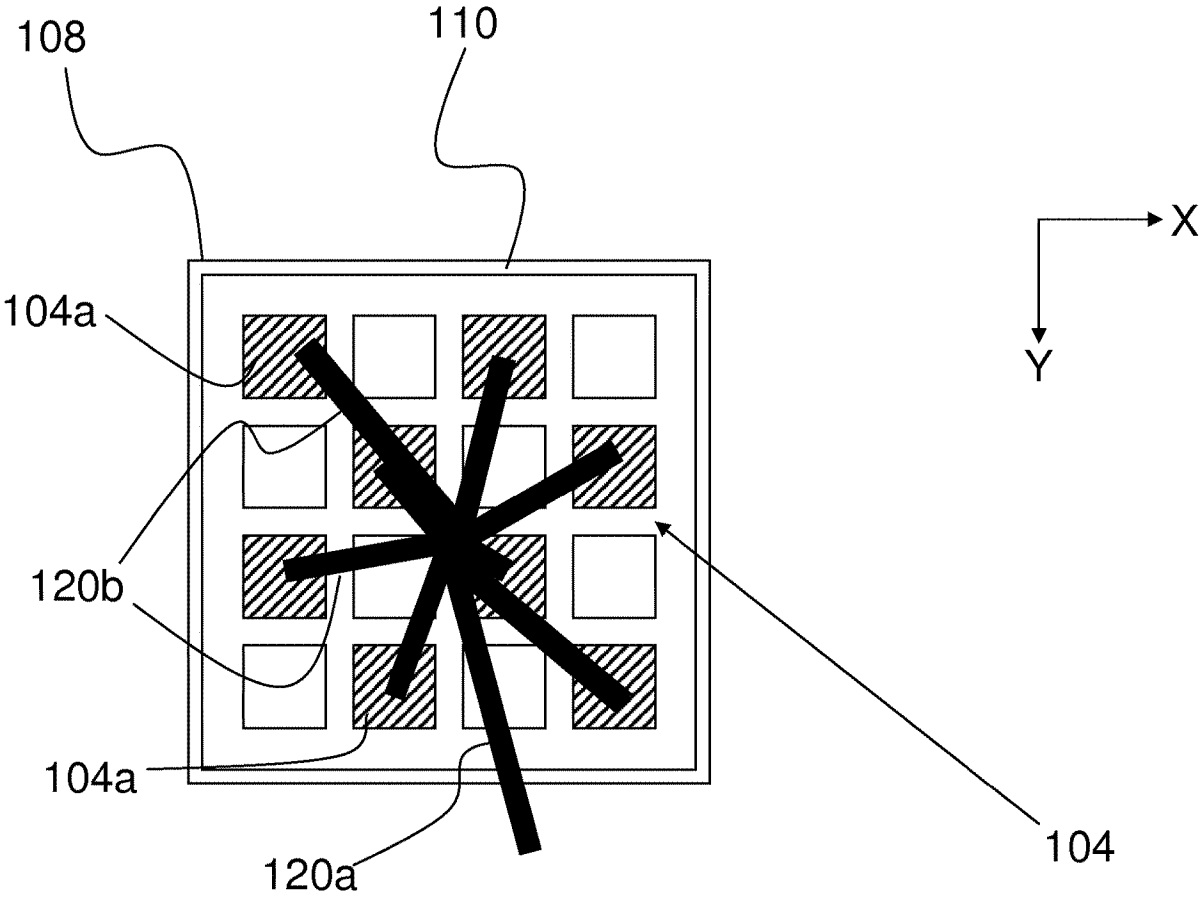

In the example shown in FIG. 9, the input couplings 104*a* receive signals via an alternative to a single feed line 120 (FIG. 8). In this example, a primary feed line 120*a* transmits signals to a plurality of secondary feed lines 120*b* which, in turn, transmit signals to the input couplings 104*a*. The structure of the primary and secondary feed lines in this example resemble a "star" or "spider" arrangement.

The impedance of the feed lines is another factor that affects the degree of coupling of the signal to the resonance modes in the resonator body 102.

As is mentioned briefly above, the degree of coupling, and the particular resonance mode to which a coupling is made can be determined, in part, by the phase of a signal at a particular coupling element. FIGS. 8 and 9 show alternative arrangements of feed or transmission lines 120 that transmit signals from a signal source (not shown) to one or more of the coupling elements of the coupling structure 104. The length of the feed line along which a signal is transmitted affects the phase of the signal when it arrives at a coupling element. That is to say, a first signal that travels comparatively greater distance along a feed line to a coupling element will be at least partially out of phase with a second signal that travels a comparatively shorter distance along a feed line. Of course, if the extra distance travelled by a first signal is equal to one complete cycle of the that signal, then the first and second signals would be in phase with one another.

The relative phases of signals at the coupling elements can be dictated by configuring the length of the feed line along which the signals are transmitted. By dictating the phase of the signals at each coupling element, it is possible to control higher-order spurious modes and, preferably, reduce their amplitude. By reducing the amplitude of the spurious higher-order modes, filter designers are able to meet demanding filter specifications without the need to make significant, complex and expensive structural modifications to the dielectric material or the need to provide additional filtering stages to attenuate the unwanted responses.

Figure 10:
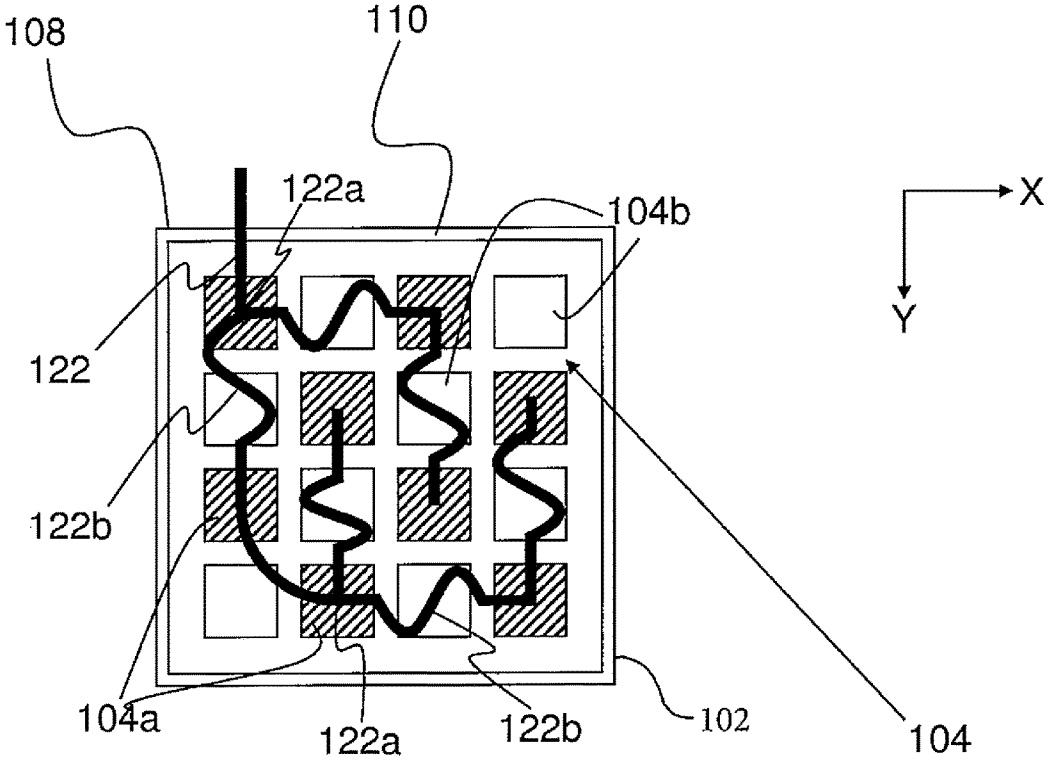
Figure 11:
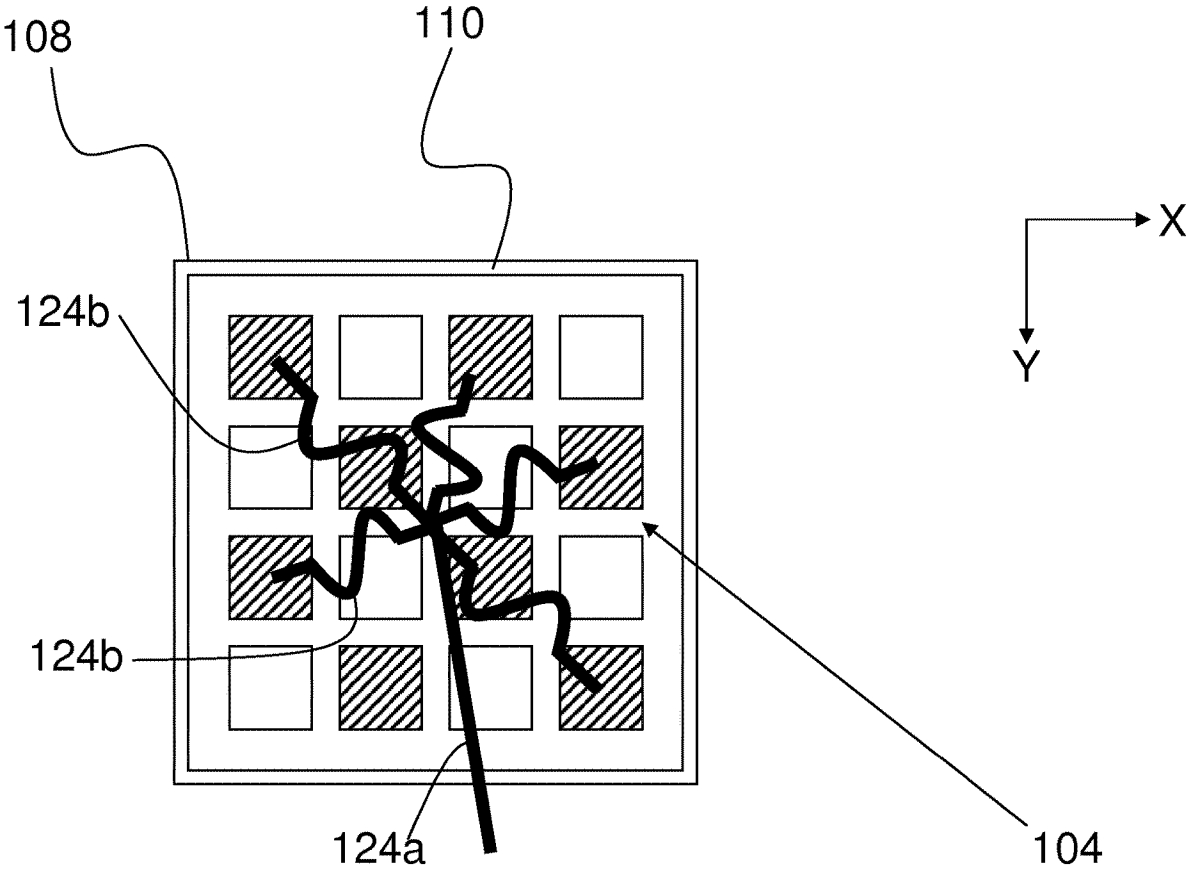

FIG. 10 shows an underside view of the resonator body 102 with a plurality of input couplings 104*a* and a plurality of output couplings 104*b*. In this example, a feed line 122 provides a connection between all of the input couplings 104*a*. In contrast to the examples shown in FIGS. 8 and 9, the feed line 122 of FIG. 10 includes a number of junctions 122*a* which allow the feed line to be directed to desired coupling elements on the resonator body 102. In addition, the feed line 122 includes a number of meanders 122*b* which serve to increase the length of the feed line between coupling elements on the line. As discussed above, the distance that a signal travels along a feed line dictates, in part, the phase of the signal at a coupling element. Therefore, it is possible to achieve a phase of a signal at a particular coupling element by designing the feed line such that the signal travels an appropriate distance along the feed line to reach the coupling element. Of course, it will be apparent to those skilled in the art that, while the feed line is shown to meander in this invention, other mechanisms for increasing the length of the feed line could alternatively be used. Similarly, the feed line may comprise a single continuous feed line with no junctions, and incorporating fewer or more meanders or similar mechanisms for increasing the length of the feed line between coupling elements. Alternatively, the feed line arrangement may be similar to the arrangement shown in FIG. 9, with meanders being incorporated into the secondary feed lines 120*b*. An example of such an arrangement is shown in FIG. 11. A primary feed line 124*a* transmits signals to a plurality of secondary feed lines 124*b*, each of which is coupled to a coupling element. While, in this example, only five secondary feed lines 124*b* are shown, in practice, any number of secondary feed lines may be incorporated, connecting the primary feed line 124*a* to any number of coupling elements, as required by the design of the filter.

In practice, the length of the feed line 122 feeding each coupling element is calculated, based on the desired phase at each coupling element, using an electromagnetic simulation tool, such as CST Microwave Studio, manufactured by Computer Simulation Technology AG.

In some examples of the invention, a concept known as amplitude tapering may be used to control and specify the amplitude across the array of coupling elements. In one scenario, the amplitude of the signal transmitted to coupling elements at the centre of the array is greater than the amplitude of the signal or signals transmitted to coupling elements surrounding the central element, and the coupling elements around the periphery of the array. This concept is advantageous in targeting the excitation predominantly to a specific mode, for example, in the case of an array of patches, this mechanism would target a known mode such as the TM110 mode.

In an alternative scenario, the amplitude of the signal transmitted to coupling elements at the centre of the array is lower than the amplitude of the signal or signals transmitted to coupling elements surrounding the central element, and the coupling elements around the periphery of the array. This concept is advantageous as a means to minimise mutual coupling between a group of input elements on one side of the array (and hence resonator body) and output elements on the other side.

An advantage of the above-described examples is that, by controlling particular design aspects of the filter, such as the size, shape and location of the coupling elements, and the length and other aspects of the transmission line feeding signals to the coupling elements, it is possible to accurately control the fields generated as a result of the signal and, thus, the excitation modes of the resonator body that are excited by the signals.

In the examples described above, a cuboid resonator body 102 is used. Such a resonator body enables coupling of up to three resonance modes. However, as will be apparent to those skilled in the art, a resonator body of a different three-dimensional shape may provide a different number of degenerate resonance modes. For example, a rectangular cuboid resonator body (that is a 2:2:1 ratio cuboid) has four degenerate resonance modes. Thus, filters can be designed having one or more resonator bodies or the same or different shapes, depending on the required characteristics of the filter.

Moreover, characteristics of a filter may be chosen by applying defects to the resonator body. Such defects may include shaving a particular amount of dielectric material from an edge of the resonator body, or drilling one or more holes of a particular size into the body.

In some scenarios, a single resonator body cannot provide adequate performance (for example, attenuation of out of band signals). In this instance, filter performance can be improved by providing two or more resonator bodies arranged in series, to thereby implement a higher-performance filter.

In one example, this can be achieved by providing two resonator bodies in contact with each other, with one or more apertures provided in the silver coatings of the resonator bodies, where the bodies are in contact. This allows the fields in each cube to enter the adjacent cube, so that a resonator body can receive a signal from or provide a signal to another resonator body. When two resonator bodies are connected, this allows each resonator body to include only a single coupling array, with a coupling array on one resonator body acting as an input and the coupling array on the other resonator body acting as an output. Alternatively, the input of a downstream filter can be coupled to the output of an upstream filter using a suitable connection such as a short transmission line.

The above described examples have focused on coupling to up to four modes. It will be appreciated this allows coupling to be to low order resonance modes of the resonator body. However, this is not essential, and additionally or alternatively coupling could be to higher order resonance modes of the resonator body.

Persons skilled in the art will appreciate that numerous variations and modifications will become apparent. All such variations and modifications which become apparent to persons skilled in the art are considered to fall within the spirit and scope of the invention broadly appearing before described.

The invention claimed is:

1. A multi-mode cavity filter comprising:

a dielectric resonator body incorporating a piece of dielectric material, the piece of dielectric material having a shape supporting at least two substantially degenerate resonant modes;

a substrate, said dielectric resonator body being coupled to said substrate, said substrate including at least one feed line; and a phased array of coupling elements between said substrate and said dielectric resonator body, said phased array of coupling elements including a plurality of input couplings and a plurality of output couplings, said plurality of input couplings being distinct from said plurality of output couplings, said plurality of input couplings being used simultaneously for coupling signals received through said at least one feed line to the piece of dielectric material with a phase preselected for each of said input couplings, wherein the signal received by each of said plurality of input couplings exhibits a specific phase that depends upon a length along said at least one feed line from an input point for the signal.

2. A multi-mode cavity filter according to claim 1, wherein at least some of the phased array of coupling elements are patches formed on a surface of the piece of dielectric material.

3. A multi-mode cavity filter according to claim 2, wherein at least some of the patches are of a regular geometric shape.

4. A multi-mode cavity filter according to claim 1, wherein said at least one feed line includes at least one meander.

5. A multi-mode cavity filter according to claim 1, wherein at least some of said phased array of coupling elements are magnetic field generating elements.

6. A multi-mode cavity filter according to claim 1, wherein at least some of said plurality of input couplings are connected to one another in series.

7. A multi-mode cavity filter according to claim 1, wherein said at least one feed line comprises a primary feed line configured to feed signals to a plurality of secondary feed lines branching off said primary feed line; and wherein each of the plurality of secondary feed lines is configured to transmit a signal to at least one input coupling.

8. A multi-mode cavity filter according to claim 1, wherein each one of the phased array of coupling elements is electrically independent from the others.

9. A multi-mode cavity filter according to claim 1, further comprising an amplitude determination mechanism for determining the amplitude of the signal transmitted along said at least one feed line.

10. A multi-mode cavity filter according to claim 9, wherein the signals transmitted to each one of the phased array of coupling elements exhibit a respective amplitude that is predetermined.

11. A multi-mode cavity filter according to claim 1, wherein the phased array of coupling elements is arranged in a substantially symmetrical array.

12. A multi-mode cavity filter according to claim 1, wherein said plurality of output couplings is arranged to recover signals from the piece of dielectric material.

13. A multi-mode cavity filter according to claim 1, wherein at least some of said phased array of coupling elements are probes arranged to abut a surface of, or at least partially penetrate a surface of, the piece of dielectric material.

14. A multi-mode cavity filter according to claim 13, wherein said probes have a substantially circular cross section.

15. A multi-mode cavity filter according to claim 13, further comprising a shielding element associated with each probe.

16. A method of manufacturing a multi-mode cavity filter, the method comprising:

providing a dielectric resonator body of dielectric material having a shape supporting at least two substantially degenerate resonant modes;

coupling said dielectric resonator body to a substrate, said substrate including at least one feed line; and providing a phased array of coupling elements between said substrate and said dielectric resonator body, said phased array of coupling elements including a plurality of input couplings and a plurality of output couplings, said plurality of input couplings being distinct from said plurality of output couplings, said plurality of input couplings being used simultaneously for coupling signals received through said at least one feed line to the piece of dielectric material with a phase preselected for each of said input couplings, wherein the signal received by each of said plurality of input couplings exhibits a specific phase that depends upon a length along said at least one feed line from an input point for the signal.

* * * * *